US006755924B2

(12) United States Patent
Harrison et al.

(10) Patent No.: US 6,755,924 B2
(45) Date of Patent: Jun. 29, 2004

(54) METHOD OF RESTORATION OF MECHANICAL PROPERTIES OF A CAST NICKEL-BASED SUPER ALLOY FOR SERVICED AIRCRAFT COMPONENTS

(75) Inventors: William Henry Harrison, Cleves, OH (US); Thomas Joseph Kelly, Cincinnati, OH (US); Michael James Weimer, Loveland, OH (US)

(73) Assignee: General Electric Company, Schenectady, NY (US)

( * ) Notice: Subject to any disclaimer, the term of this patent is extended or adjusted under 35 U.S.C. 154(b) by 109 days.

(21) Appl. No.: 10/029,365

(22) Filed: Dec. 20, 2001

(65) Prior Publication Data

US 2003/0116242 A1 Jun. 26, 2003

(51) Int. Cl.[7] ..... C22F 1/10
(52) U.S. Cl. ..... 148/675; 148/527; 29/889.1
(58) Field of Search ..... 148/527, 675; 29/889.1

(56) References Cited

U.S. PATENT DOCUMENTS

| | | | | |
|---|---|---|---|---|
| 3,933,000 A | | 1/1976 | Doody | |
| 4,126,295 A | | 11/1978 | Natalizia | |
| 4,171,093 A | | 10/1979 | Honeycutt, Jr. et al. | |
| 4,188,194 A | | 2/1980 | Corrigan | |
| 4,235,418 A | | 11/1980 | Natalizia | |
| 4,247,755 A | | 1/1981 | Smith, Jr. et al. | |
| 4,459,045 A | | 7/1984 | Smith | |
| 4,482,398 A | | 11/1984 | Eylon et al. | |
| 4,620,662 A | | 11/1986 | Driggers | |
| 4,636,353 A | | 1/1987 | Seon et al. | |
| 4,832,892 A | | 5/1989 | Newkirk et al. | |
| 4,841,614 A | | 6/1989 | MacNitt et al. | |
| 4,973,366 A | | 11/1990 | Yasuda et al. | |
| 5,013,438 A | | 5/1991 | Smith | |
| 5,036,770 A | | 8/1991 | Llewellin et al. | |
| 5,040,718 A | * | 8/1991 | Lee et al. | 228/119 |
| 5,071,054 A | * | 12/1991 | Dzugan et al. | 228/119 |
| 5,123,678 A | | 6/1992 | Froger et al. | |
| 5,159,307 A | | 10/1992 | Wells et al. | |
| 5,166,569 A | | 11/1992 | Shervington et al. | |
| 5,238,334 A | | 8/1993 | Brandt et al. | |
| 5,254,142 A | | 10/1993 | Johansson et al. | |
| 5,352,526 A | | 10/1994 | Solanki et al. | |
| 5,688,729 A | | 11/1997 | Andersson et al. | |
| 6,132,527 A | | 10/2000 | Hessell et al. | |
| 6,139,055 A | | 10/2000 | Dahl et al. | |
| 6,169,048 B1 | | 1/2001 | Sjogren et al. | |
| 6,195,891 B1 | * | 3/2001 | Chen et al. | 29/889.1 |
| 6,531,005 B1 | * | 3/2003 | Bezerra et al. | 148/516 |
| 6,532,656 B1 | * | 3/2003 | Wilkins et al. | 29/889.1 |
| 2003/0066192 A1 | * | 4/2003 | Wilkins | 29/889.1 |

* cited by examiner

*Primary Examiner*—John P Sheehan
(74) *Attorney, Agent, or Firm*—Jonathan P. Miller; Carmen Santa Maria; McNees Wallace & Nurick LLC

(57) ABSTRACT

A heat treatment process that will restore the mechanical properties of an aircraft engine article that includes a cast nickel-based superalloy portion welded to a wrought portion. The heat treatment process includes placing an article that includes the nickel-based superalloy cast portion into a heat treatment chamber, evacuating the chamber to a suitable atmosphere, heating the chamber in a manner that minimizes distortion of the cast portion to a temperature in the range of 1950° F. to 2050° F., holding the temperature in that range for a period of time sufficient to solution all the delta phase precipitates, and then cooling the article to room temperature in a manner that minimizes distortion of the article. After solution heat treatment, the wrought portion of the engine part can be removed and replaced and the engine article can be reprocessed.

18 Claims, 2 Drawing Sheets

TIME–TEMPERATURE TRANSFORMATION DIAGRAM FOR ALLOY 718

TEMPERATURE–PHASE STABILITY DIAGRAM FOR CAST 718 ALONG WITH TEMPERATURE FOR HOMOGENIZATION AND HIP HEAT TREAT CYCLE

METHOD OF RESTORATION OF MECHANICAL PROPERTIES OF A CAST NICKEL-BASED SUPER ALLOY FOR SERVICED AIRCRAFT COMPONENTS

FIELD OF THE INVENTION

The present invention is directed to structural aircraft components composed of cast INCONEL® 718 and forged WASPALOY™ or cast INCONEL® 718 and forged INCOLOY® 718/903/907/909, among others.

BACKGROUND OF THE INVENTION

Many structural aircraft engine components are made of a combination of either solid cast INCONEL® 718 or cast INCONEL® 718 and a separate forged component. INCONEL® is a registered trademark of Huntington Alloys Corporation of Huntington, W. Va. The separate forged component is usually a material such as forged INCONEL® 718, forged WASPALOY™, or forged INCOLOY® 903/907/909, among others. WASPALOY™ is an unregistered trademark of Haynes International, Inc. of Kokomo, Ind. INCOLOY® is a registered trademark of Inco Alloys International, Inc. of Huntington, W. Va. These materials are commonly joined as an inseparable assembly by welding them together. During engine operation, these components may develop cracking in one of the materials rendering the component non-serviceable.

Cast INCONEL® 718 is a nickel based superalloy that obtains its desirable properties by precipitation hardening at an elevated temperature. INCONEL® 718 is a well-known trademark for a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel, which composition is well-known to those skilled in the art. Both the cast INCONEL® 718 and the associated wrought structures have the desirable physical properties of warm temperature strength, creep strength, stress rupture strength, and fatigue resistance, for application of the article as a high temperature engine aircraft structural component. In order to obtain these desirable properties, both the cast INCONEL® 718 and the associated wrought structures require a proper amount of the gamma-prime ($\gamma'$) phase and the gamma-double-prime ($\gamma''$) phase. The $\gamma''$ phase, which is a body-centered tetragonal precipitate in a simple face-centered cubic structure, is metastable and forms an undesirable phase, the delta phase ($\delta$), in the temperature range of 1200° F. to 1800° F. The $\delta$ phase nucleates at the grain boundaries of the cast INCONEL® 718 and the associated wrought structures at the expense of $\gamma''$ which $\delta$ phase coarsens rapidly unless it is solutioned at elevated temperatures. The presence of $\delta$ leads to the degradation of both weldability and the mechanical properties of the cast INCONEL® 718 and the associated wrought structure.

A method for repairing these cracks is generally found in engine maintenance manuals, which allow the components to be repaired and returned to serviceable condition Typically, these repair methods consist of welding the cracks in order to heal them, followed by a stress relief beat treatment. For cast INCONEL® 718 with forged attachment parts the repair process consists of pre-heating the assembly at about 1750° F. for about one hour, post weld heat treating at about 1750° F. for one hour, followed by an aging heat treatment to form $\gamma''$.

The aerospace structural components employing cast INCONEL® 718 are not life limited. Such structural components have no planted time for their obsolescence. Included in these components are major aircraft engine frames, cases and supports that are inspected at certain durations of time and or cycles of the engine. If non-serviceable conditions are found during these inspections, then the non-conforming components are disassembled from the engine and sent to a repair shop. This is commonly called a "shop visit".

It is not uncommon to find cracking on INCONEL® 718 components that require the standard weld and heat treat repair during shop visits as set forth above. Such visits cause multiple generations of weld and heat treat repairs. These multi-generational repairs cause degradation of the cast INCONEL® 718 material due to the formation of $\delta$ phase precipitates over time. Data from several repair stations show that the effectiveness of the weld/heat repairs decrease proportionally with the frequency of these repairs. For example on the CF6-50 Compressor Rear Frame, one airline reports that the frame will be operated on an engine for an average of 25,000 hours before a crack appears at the bleed ports at the end of the struts. After the crack is repaired by performing known local weld/heat treat repair processes, and the frame is returned to service, a new crack will appear in the area of the bleed port near the weld/heat treat repair. The average time for a new crack to appear is 5,000 hours after the original repair. Therefore, if the time it takes for a crack to appear from the time the new frame is placed in service is about 25,000 hours, then the time it takes a new crack to appear after a weld and heat treat repair is about 20% of the original service time. This is just one example of many reports from different airlines.

The primary cause of the reduced service usage (crack free) of the frames after repair is the degradation of the cast INCONEL® 718 material. Repeated heating and cooling cycles in the temperature range of 1700° F. to 1800° F. causes formation of the $\delta$ phase. The material accumulates delta phase material from the weld and heat treat repair, which is exacerbated with multiple cycles. The presence of this delta phase indicates that the distribution of certain key elements in the alloy is altered in such a way that elements have collectively migrated to certain areas where they are now highly concentrated. This depletes these elements from other areas, decreasing the mechanical properties of the alloy in these areas. Therefore, key elements must be redistributed properly in the alloy to prevent cracking, since the mechanical properties of cast INCONEL® 718 are decreased when $\delta$ is present.

SUMMARY OF THE INVENTION

The present invention is directed toward improvements in the repair and heat treatments used to restore cast INCONEL® 718 aircraft engine parts to provide a more uniform distribution of elements. Over time, and after numerous crack repairs and heat treatments, the mechanical properties of cast INCONEL® 718 deteriorates. The process of the present invention allows the restoration of cast INCONEL® 718 to a state which is similar to the condition of the cast INCONEL® 718 immediately after manufacture.

The article, which includes a cast INCONEL® 718 component is restored through a process that includes beat treatment. First, the article that typically includes a cast portion and a forged portion is placed into a heat treatment chamber, purged of oxygen and the pressure in the chamber is set to a suitable neutral or reducing atmosphere. The article is then heated, at a rate suitable to minimize distortion, to a temperature in the range of about 1950° F. to about 215 ° F. The temperature of the article is then held in a range of about 1950° F. to about 2150° F. for a time sufficient to solutionize the delta phase precipitates and homogenize the alloy. The article is then cooled at a rate sufficient to avoid delta phase precipitation in the range of about 1600° F. to about 1900° F. in a protective neutral or reducing atmosphere at a rate sufficient to maintain dimensional stability. The article should then be air quenched, or quenched in an inert gas at an equivalent rate, to room temperature. The forged portion can then be removed, leaving a cast portion that has essentially a solutioned condition. As used herein, the terms "wrought" and "forged" are used interchangeably. The cast portion can then be reused, while the wrought portion is disgarded Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides a novel method of heat treating to restore the mechanical properties of cast INCONEL® 718 included as part of an aircraft engine. INCONEL® 718 is a well-known trademark for a nickel-based superalloy having a nominal composition, in weight percent of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel, which composition is well-known to those skilled in the art. The frame that includes the restored cast INCONEL® 718 component thus will benefit from decreased shop visit repairs of the cast INCONEL® 718 component of the article. Future maintenance costs of the frame will also be decreased.

In order to restore the mechanical properties of a frame that includes a cast INCONEL® 718 component, a number of heat cycle steps must be performed to properly re-solution the INCONEL® 718 component. The forged component of the article must remain attached to the cast component of the article so that the cast component will retain its dimensional stability during the heat treatment process.

Figure 1:
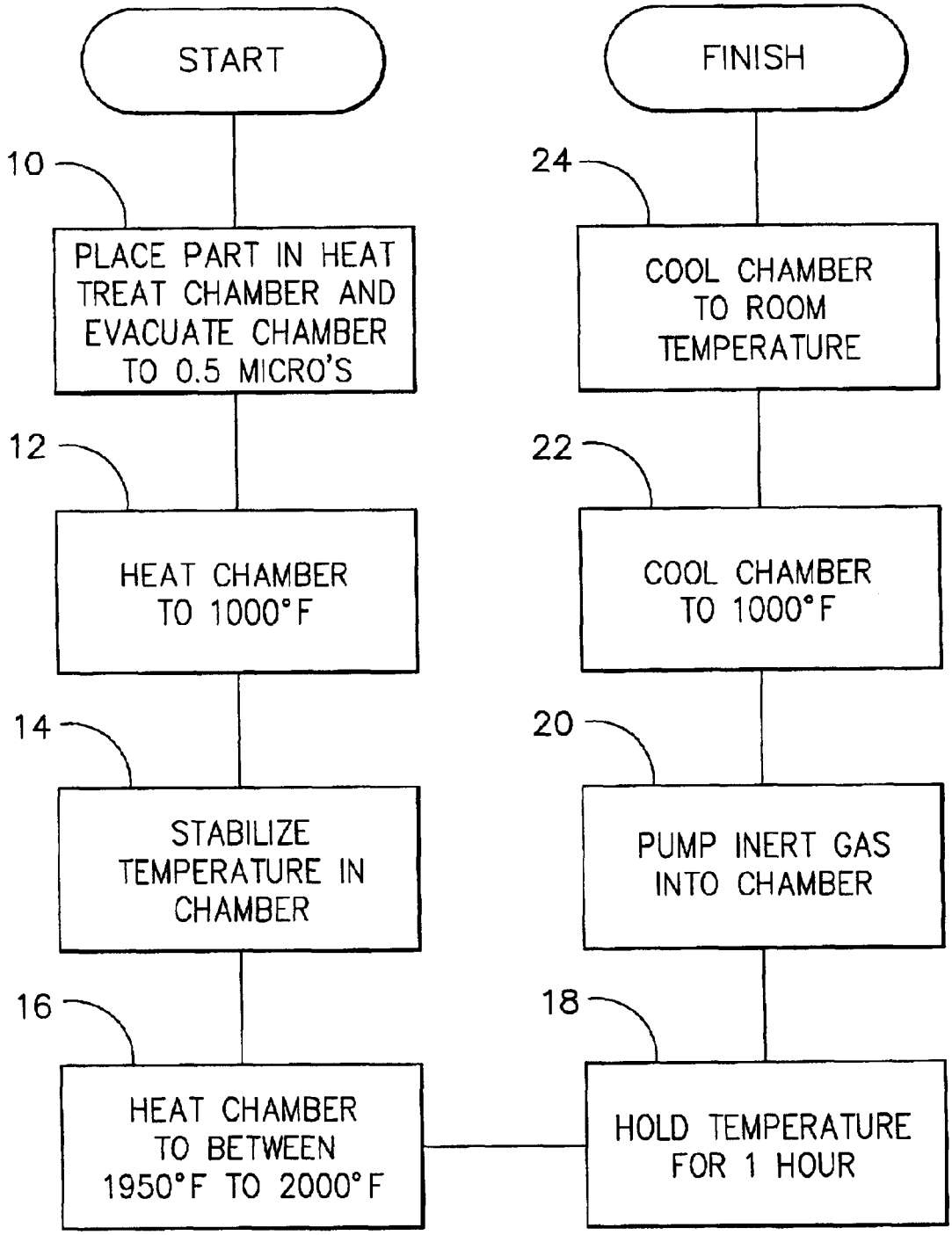
FIG. 1 is a flow chart illustrating a process by which an aircraft engine part composed in whole or in part of a component that includes cast INCONEL® 718 can be restored after cracking.

Referring now to FIG. 1., there is shown a flow chart illustrating the steps that the article which includes the cast INCONEL® 718 portion must undergo in order to have the original mechanical properties of the cast INCONEL® 718 portion restored after cracking. The article which includes the cast INCONEL® 718 portion is first placed in a heat treatment chamber, which is well known to one skilled in the art, and the chamber is evacuated to an atmosphere of about 0.5 micron or purged with a non-reactive gas, represented by numeral 10. The article is then heated to a temperature within the range of about 975° F. to about 1025° F., represented by numeral 12. When the heating to a range of about 975° F. to about 1025° F. is complete, the temperature is held within that range, represented by numeral 14. The article is then heated to a temperature in the range of about 1950° F. to about 2150° F. within 60 minutes of the prior temperature stabilization, represented by numeral 16. The temperature of the article is then held at a temperature in the range of about 1950° F. to about 2150° F. for a period of time in the range of about 55 minutes to about 65 minutes, represented by numeral 18. This amount of time should permit the δ phase to be fully solutioned. However, depending upon the size of the article, typically a frame for use with an aircraft engine, shorter or longer times may be used. Inert or non-reactive gas is then introduced into the chamber, if not already present, represented by numeral 20. The chamber is cooled to a temperature in the range of about 1000° F. to about 1200° F. at a rate sufficient to avoid the formation of δ phase in the cast Inconel 718 portion, typically not less than 30° F. per minute, reheated and held for a time to precipitate γ", represented by numeral 22. The chamber is then cooled by air, or at a rate which is equivalent to cooling by air, to room temperature 24.

Figure 2:
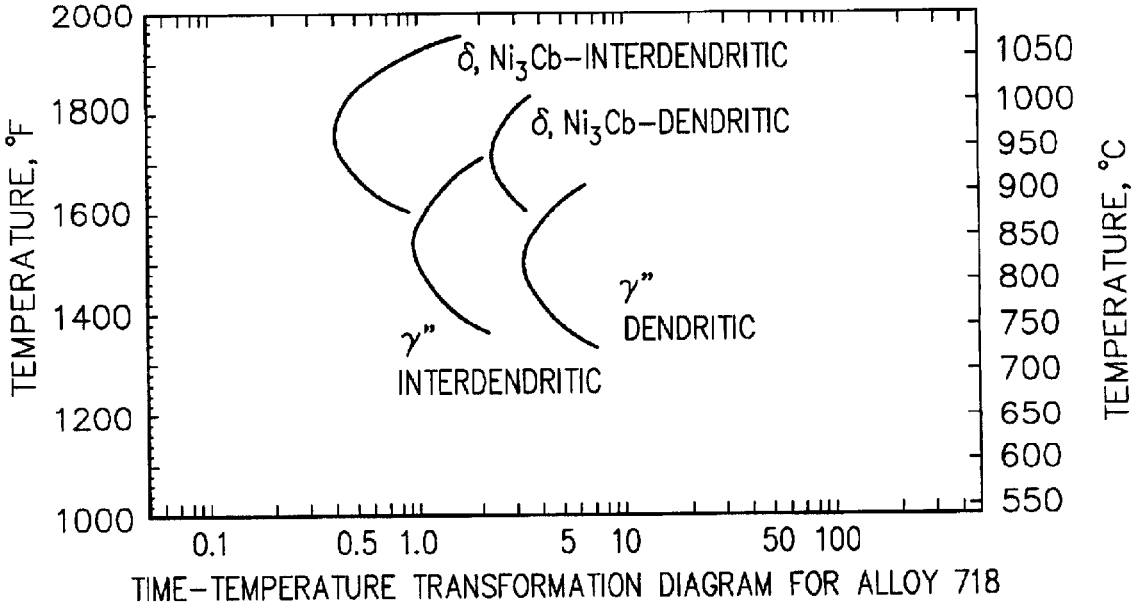
FIG. 2 is a Time-Temperature-Transformation diagram for cast INCONEL® 718.
Figure 3:
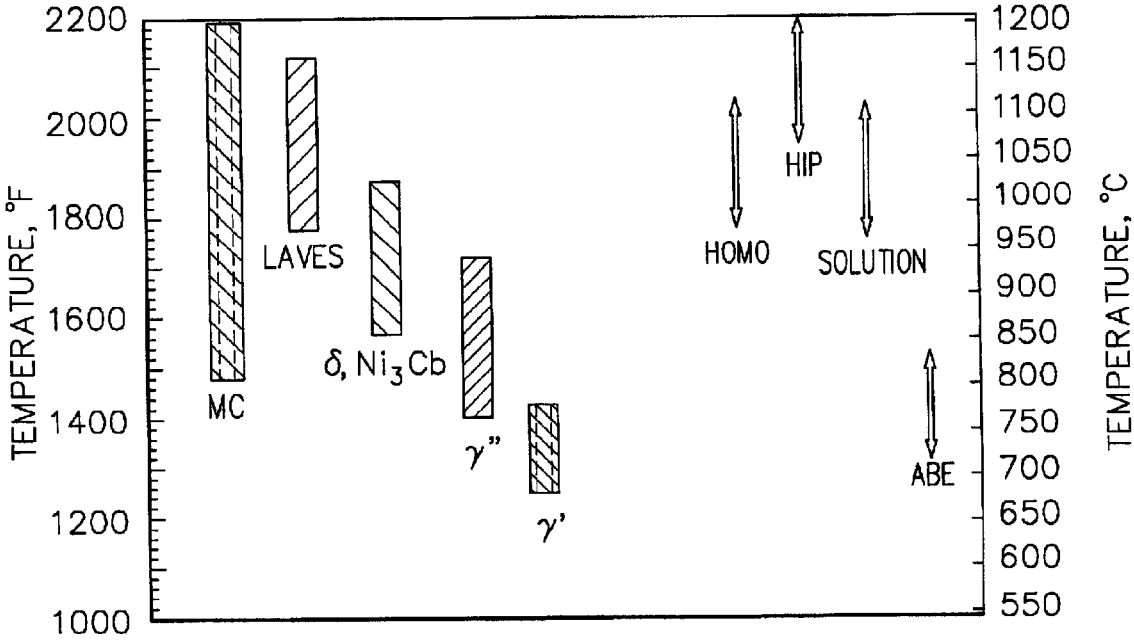
FIG. 3 is a Tempera Phase Stability Diagram for cast INCONEL® 718.

Referring to FIGS. 2 and 3 which arm a Time-Temperature-Transformation ("TTT") diagram for cast INCONEL® 718 and a Temperature-Phase Stability diagram for cast INCONEL® 718, both available in an article entitled "Microstructural Characterization of Cast 718" in a collection *Superalloy* 718— *Metallurgy and Applications*, edited by E. A Loria, The Minerals, Metals & Materials Society, 1989, it can be seen that if an INCONEL® 718 article is not cooled through the nose of the upper TTT curve, undesirable δ phase cannot begin to precipitate. Formation of this phase can be avoided, and cooling rapidly to 1000° F. to 1200° F. prevents formation of this phase. However, in order to avoid distortion due to stresses set up from rapid cooling from the elevated temperature, it is necessary to leave the forged portion of the frame attached to the cast portion of the frame.

Once the heat treat cycle is complete, the article, typically a frame, is machined to removed the forged portion from the cast INCONEL® 718 portion of the article. The restored cast INCONEL® 718 portion of the article is then welded to a new forged portion to create a new inseparable article. The exact process will vary depending on the size (i.e. type of aircraft engine frame) of cast INCONEL® 718 frame that requires treatment using this heat treat process.

Once the new forged component is welded to the cast INCONEL® 718 component, the solution and heat treat cycles defined on the original manufacture engineering drawings for the individual components can be performed. There may be exceptions for performing post-weld heat cycles, for example stress relief cycles, specific to an engine type, and not all frame designs specify a post weld solution heat treatment. However, the cast 718 portion of a frame removed from service and repaired in accordance with the present invention with the subsequent welding of a new wrought portion can be processed in the same manner as a new frame made from a new 718 cast portion and a new wrought portion.

After the cast INCONEL® 718 portion has been solutioned within the temperature range of about 1950° F. to about 2150° F., and the initial or old wrought portion has been machined away, a new wrought portion can then be attached to the casting. When the article that includes the cast INCONEL® 718 component to be treated does not require a special post weld solution heat treatment as set forth on the drawings, a stress relief heat treatment and an age-hardening heat treatment to properly age the part nevertheless should be performed to fully develop the mechanical properties of the cast INCONEL® 718 portion and the attached wrought portion. Because the wrought portion can be comprised of a variety of heat treatable alloys whose properties are developed by different heat treatments, these age treatments can vary as set forth below.

After the cast INCONEL® 718 component has been solutioned within the temperature range of about 1950° F. to about 2150° F. and the initial wrought casting has been machined away, a new wrought portion can then be attached to the casting. When the article includes a cast INCONEL® 718 component welded to either a wrought WASPALOY™ component or a wrought RENE®-41 component, after the components are welded together, in order to relieve weld stresses and to properly age the article, the article should be heat treated in the range of about 1500° F. to about 1600° F. for about one hour, followed by a heat treatment in the range of about 1250°F. to about 1350° F. for about eight hours, followed by a heat treatment in the range of about 1150° F. to about 1250° F. for about one hour. WASPALOY™ is a well-known trademark for a nickel-based superalloy having a nominal composition, in weight percent, of about 19 percent chromium, about 12.3 percent cobalt, about 3.8 percent molybdenum, about 3.0 percent titanium, about 1.2 percent aluminum, about 0.01 percent zirconium, about 0.45 percent, manganese, about 0.06 percent carbon, about 0.005 percent boron, and balance nickel, which composition is well-known to those skilled in the art RENE® is a registered trademark of Teledyne Industries, Inc. of Los Angeles, Calif. RENE®-41 is a well known trademark for a nickel-based superalloy having a nominal composition, in weight percent of about 19.0 percent chromium, about 10.5 percent cobalt, about 9.5 percent molybdenum, about 3.2 percent titanium, about 1.7 percent aluminum, about 0.01 percent zirconium, about 0.08 percent carbon, about 0.005 percent boron, and balance nickel, which composition is well known to those skilled in the art. In a more preferred embodiment, in order to relieve welding stress and to age the article, the article should be heat treated at about 1550° F.±25° F. for about one hour, followed by a heat treatment at about 1325° F.±25° F. for about eight hours, followed by a heat treatment at about 1200° F.±25° F. for about one hour.

After the cast INCONEL® 718 component has been solutioned within the temperature range of about 1950° F. to about 2150° F. and the initial wrought casting has been machined away, a new wrought component can then be attached to the casting. When the article is a cast INCONEL® 718 component welded to a INCOLOY® 907 wrought component, after the components are welded together, in order to relieve weld stresses and to age the article, the article should be heat treated in the range of about 1500° F. to about 1600° F. for about one hour, followed by a heat treatment in the range of about 1400° F. to about 1525° F. for about sixteen hours, followed by a heat treatment in the range of about 1100° F. to about 1200° F. for about eight hours. INCOLOY® 907 is a well-known trademark for an iron-based superalloy having a nominal composition, in weight percent, of about 38 percent nickel, about 13 percent cobalt, about 4.7 percent niobium, about 1.5 percent titanium, about 0.15 percent silicon, about 0.03 percent aluminum, and about 42 percent iron, which composition is well-known to those skilled in the art. In a more preferred embodiment, in order to relieve welding stress and to age the article, the article should be heat treated at about 1550° F.±25° F. for about one hour, followed by a heat treatment at about 1475° F.±25° F. for about sixteen hours, followed by a heat treatment at about 1150° F.±25° F. for about eight hours.

After the cast INCONEL® 718 component has been solutioned within the temperature range of about 1950° F. to about 2150° F. and the initial wrought casting has been machined away, a new wrought component can then be attached to the casting. When the article is a cast INCONEL® 718 component welded to a wrought INCOLOY® 909 component, after the components are welded together, in order to relieve weld stresses and to age the article, the article should be heat treated in the range of about 1500° F. to about 1600° F. for about one hour, followed by a heat treatment in the range of about 1350° F. to about 1450° F. for about eight hours, followed by a heat treatment in the range of about 1100° F. to about 1225° F. for about four hours. INCOLOY® 909 is a well-known trademark for an iron-based superalloy having a nominal composition, in weight percent, of about 38.0 percent nickel, about 13.0 percent cobalt, about 4.7 percent niobium, about 1.5 percent titanium, about 0.4 percent silicon, about 0.01 percent carbon, about 0.001 percent boron, and about 42.0 percent iron, which composition is well-known to those skilled in the art. In a more preferred embodiment, in order to relieve welding stress and to age the article, the article should be heat treated at about 1425° F.±25° F. for about eight hours, followed by a heat treatment at about 1150° F.±25° F. for about four hours, followed by a heat treatment at about 1200° F.±25° F. for about one hour.

After the cast INCONEL® 718 component has been solutioned within the temperature range of about 1950° F. to about 2150° F. and the initial wrought casting has been machined away, a new wrought component can then be attached to the casting. When the article is a cast INCONEL® 718 component welded to a wrought INCOLOY® 903 component, after the components are welded together, in order to relieve weld stresses and to age the article, the article should be heat treated in the range of about 1500° F. to about 1600° F. for about one hour, followed by a heat treatment in the range of about 1250° F. to about 1350° F. for about eight hours followed by a heat treatment in the range of about 1100° F. to about 1200° F. INCOLOY® 903 is a well-known trademark for an iron-based superalloy having a nominal composition, in weight percent, of about 38 percent nicked 15 percent cobalt, 0.7 percent aluminum, 1.4 percent titanium, 3 percent niobium, and 41.0 percent iron, which composition is well-known to those skilled in the art. In a more preferred embodiment, in order to relieve welding stress and to age the article, the article should be heat treated at about 1550° F.±25° F. for about one hour, followed by a heat treatment at about 1325° F.±25° F. for about eight hours, followed by a heat treatment at about 1200° F.±25° F. for about one hour.

After the cast INCONEL® 718 component has been solutioned within the temperature range of about 1950° F. to about 2150° F. and the initial wrought casting has been machined away, a new wrought compound can then be attached to the casting. When the article is a cast INCONEL® 718 component welded to a wrought INCONEL® 718 component, after the components are welded together, in order to relieve weld stresses and to age the article, the article should be heat treated in the range of about 1500° F. to about 1600° F. for about one hour, followed by a heat treatment in the range of about 1350° F. to about 1450° F. for about eight hours, followed by a heat treatment in the range of about 1100° F. to about 1200° F. for about four hours. In a more preferred embodiment, in order to relieve welding stress and to age the article, the article should be heat treated at about 1550° F.±25° F. for about one hour, followed by a heat treatment at about 1425° F.±25° F. for about eight hours, followed by a heat treatment at about 1150° F.±25° F. for about four hours.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat treatment process for restoring the properties of an aircraft engine article having a cast portion comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel and a forged portion that has been subjected to repeated thermal cycles below the δ solvus comprising the steps of:

providing an article comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel to be treated;

heating the article in a non-oxidative atmosphere, at a rate to minimize distortion of the article, to a temperature in a range of about 975° F. to about 1025° F. and stabilizing the temperature of the article in this temperature range;

within 60 minutes of stabilizing the article in the temperature range of about 975° F. to about 1025° F. heating the article to a second temperature in the range of about 1950° F. to about 2150° F.;

holding the article at a temperature in the range of about 1950° F. to about 2150° F. for a time sufficient to fully solution precipitates;

cooling the article to a temperature in the range of about 1000° F. to about 1200° F. in a protective atmosphere at a rate sufficient to maintain dimensional stability while avoiding the formation of δ phase;

cooling the article to room temperature; and removing the forged portion of the article.

2. The process as in claim 1, wherein the step of heating further includes a non-oxidative atmosphere is a vacuum having a pressure of about 0.5 micron.

3. The process as in claim 1, wherein the process includes welding the treated cast article comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel to new wrought portion article comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel after the cooling step, to yield a repaired article.

4. The process as in claim 3, wherein the process includes heat treating at a temperature in the range of about 1500° F. to about 1600° F, and holding for a first preselected period, followed by lowering the temperature to a temperature in the range of about 1350° F. to about 1450° F. and holding for a second preselected period, followed by lowering the temperature to a temperature in the range of about 1100° F. to about 1200° F. and holding for a third preselected period, so as to develop γ' and γ", while also relieving welding stresses in the welded article after the step of welding the wrought article to the cast article.

5. The process as in claim 4, wherein the first preselected period is about one hour, the second preselected period is about eight hours, and the third preselected period is about four hours.

6. The process as in claim 1, wherein the process includes welding, after the cooling step, the treated cast article comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel to a wrought article, wherein the wrought article is an alloy selected from the group consisting of a nickel-based superalloy having a nominal composition, in weight percent, of about 19 percent chromium, about 12.3 percent cobalt, about 3.8 percent molybdenum, about 3.0 percent titanium, about 1.2 percent aluminum, about 0.01 percent zirconium, about 0.45 percent manganese, about 0.06 percent carbon, about 0.005 percent boron, and balance nickel and a nickel-based superalloy having a nominal composition, in weight percent, of about 19.0 percent chromium, about 10.5 percent cobalt, about 9.5 percent molybdenum, about 3.2 percent titanium, about 1.7 percent aluminum, about 0.01 percent zirconium, about 0.08 percent carbon, about 0.005 percent boron, and balance nickel, to yield a repaired article.

7. The process as in claim 6, wherein the process includes heat treating at a temperature in the range of about 1500° F. to about 1600° F. and holding for a first preselected period, followed by lowering the temperature to a temperature in the range of about 1250° F. to about 1350° F. and holding for a second preselected period, followed by lowering the temperature to a temperature in the range of about 1150° F. to about 1250° F. and holding for a third preselected period, so as to develop γ' and γ", while also relieving welding stresses in the welded article after the step of welding the wrought article to the cast article.

8. The process as in claim 7, wherein the first preselected period is about one hour, the second preselected period is about eight hours, and the third preselected period is about one hour.

9. The process as in claim 1, wherein the process includes welding the treated cast article of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel to a wrought article comprising a iron-based superalloy having a nominal composition, in weight percent, of about 38 percent nickel, 15 percent cobalt, 0.7 percent aluminum, 1.4 percent titanium, 3 percent niobium, and 41.0 percent iron after the cooling step, to yield a repaired article.

10. The process as in claim 6, wherein the process includes heat treating at a temperature in the range of about 1500° F. to about 1600° F. and holding for a first preselected period, followed by lowering the temperature to a temperature in the range of about 1250° F. to about 1350° F. and holding for a second preselected period, followed by lowering the temperature to a temperature in the range of about 1100° F. to about 1200° F. and holding for a third preselected period, so as to develop γ' and γ", while also relieving welding stresses in the welded article after the step of welding the wrought article to the cast article.

11. The process as in claim 10, wherein the first preselected period is about one hour, the second preselected period is about eight hours, and the third preselected period is about eight hours.

12. The process as in claim 11, wherein the process includes welding the treated cast article comprising a nickel-based superalloy having a nominal composition, in weight percent, of about 18.5 percent iron, about 18.5 percent chromium, about 5.1 percent niobium, about 3 percent molybdenum, about 0.9 percent titanium, about 0.5 percent aluminum, about 0.04 percent carbon, and balance nickel to a wrought article comprising an iron-based superalloy having a nominal composition, in weight percent, of about 38 percent nickel, about 13 percent cobalt, about 4.7 percent niobium, about 1.5 percent titanium, about 0.15 percent silicon, about 0.03 percent aluminum, and about 42 percent iron after the cooling step, to yield a repaired article.

13. The process as in claim 12, wherein the process includes heat treating at a temperature in the range of about 1500° F. to about 1600° F. and holding for a first preselected period, followed by lowering the temperature to a temperature in the range of about 1400° F. to about 1525° F. and holding for a second preselected period, followed by lowering the temperature to a temperature in the range of about 1100° F. to about 1200° F. and holding for a third preselected period, so as to develop γ' and γ", while also relieving welding stresses in the welded article after the step of welding the wrought article to the cast article.

14. The process as in claim 13, wherein the first preselected period is about one hour, the second preselected period is about sixteen hours, and the third preselected period is about eight hours.

15. The process as in claim 1, wherein the process includes welding the treated cast article comprising a nickel-based superalloy having a nominal composition, in weight percent, to a wrought article comprising an iron-based superalloy having a nominal composition, in weight percent, of about 38.0 percent nickel, about 13.0 percent cobalt, about 4.7 percent niobium, about 1.5 percent titanium, about 0.4 percent silicon, about 0.01 percent carbon, about 0.001 percent boron, and about 42.0 percent iron after the cooling step, to yield a repaired article.

16. The process as in claim 15, wherein the process includes heat treating at a temperature in the range of about 1500° F. to about 1600° F. and holding for a first preselected period, followed by lowering the temperature to a temperature in the range of about 1350° F. to about 1450° F. and holding for a second preselected period, followed by lowering the temperature to a temperature in the range of about 1100° F. to about 1200° F. and holding for a third preselected period, so as to develop γ' and γ", while also relieving welding stresses in the welded article after the step of welding the wrought article to the cast article.

17. The process as in claim 16, wherein the first preselected period is about one hour, the second preselected period is about eight hours, and the third preselected period is about four hours.

18. The process as in claim 9, wherein the process includes heat treating at a temperature in the range of about 1550° F.±25° F. and holding for about one hour, followed by a heat treatment in the range of about 1325° F.±25° F. for about eight hours, followed by a heat treatment in a temperature in the rage of about 1200° F.±25° F. for about one hour, so as to develop γ' and γ", while also relieving welding stresses in the welded article after the step of welding the wrought article to the cast article.

* * * * *

UNITED STATES PATENT AND TRADEMARK OFFICE

CERTIFICATE OF CORRECTION

PATENT NO. : 6,755,924 B2
DATED : June 29, 2004
INVENTOR(S) : Harrison et al.

It is certified that error appears in the above-identified patent and that said Letters Patent is hereby corrected as shown below:

Column 2,
Line 63, “beat” should be -- heat --.

Column 3,
Line 3, “215° F” should be -- 2150° F --.

Column 5,
Line 29, “percent, manganese” should be -- percent manganese --.
Line 31, “art RENE®” should be -- art. RENE® --.

Column 8,
Line 9, “about 1600° F. and holding” should be -- about 1600° F. and holding --.

Signed and Sealed this

Twenty-third Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,755,924 B2
DATED : June 29, 2004
INVENTOR(S) : Harrison et al.

It is certified that error appears in the above-identified patent and that said Letters Patent is hereby corrected as shown below:

Column 8,
Line 9, "about 1600º F, and holding" should be -- about 1600º F. and holding --.

Signed and Sealed this

Eighth Day of November, 2005

JON W. DUDAS
*Director of the United States Patent and Trademark Office*